US006928738B2

(12) United States Patent
Segrea

(10) Patent No.: US 6,928,738 B2
(45) Date of Patent: Aug. 16, 2005

(54) RAZOR WITH INTEGRAL TRIMMING WAND

(76) Inventor: Geronimo Segrea, 1299 Blackburn Drive, Oakville, Ontario (CA), L6H 2N5

( * ) Notice: Subject to any disclaimer, the term of this patent is extended or adjusted under 35 U.S.C. 154(b) by 0 days.

(21) Appl. No.: 10/621,341

(22) Filed: Jul. 18, 2003

(65) Prior Publication Data

US 2005/0011072 A1 Jan. 20, 2005

(51) Int. Cl.[7] ..... B26B 21/52
(52) U.S. Cl. ..... 30/34.1; 30/535; 30/541
(58) Field of Search ..... 30/34.1, 541, 34.05, 30/535, 53, 47

(56) References Cited

U.S. PATENT DOCUMENTS

| | | | | | |
|---|---|---|---|---|---|
| 2,764,811 | A | * | 10/1956 | Guardino | 30/29.5 |
| 4,432,136 | A | | 2/1984 | Taylor | |
| 4,461,078 | A | | 7/1984 | Carreker | |
| 4,498,236 | A | * | 2/1985 | McIntyre et al. | 30/34.1 |
| 4,989,328 | A | | 2/1991 | Sokoloff | |
| 6,052,905 | A | * | 4/2000 | Branchinelli et al. | 30/50 |
| 6,581,290 | B1 | | 6/2003 | Fishel | |
| 2003/0051347 | A1 | * | 3/2003 | Melton et al. | 30/123 |

* cited by examiner

*Primary Examiner*—Douglas D Watts
(74) *Attorney, Agent, or Firm*—Ingrid E. Schmidt

(57) ABSTRACT

A razor has an elongate handle body with a shaving head at one end, the other end of the handle body as a body cavity for receiving a trimming wand with a smaller blade than the shaving head. The trimming wand is normally concealed by the razor body but can be selectively exposed for use by sliding the trimming wand, along the razor body, pivoting the trimming wand, or separating the razor body into components which expose the trimming wand.

3 Claims, 5 Drawing Sheets

RAZOR WITH INTEGRAL TRIMMING WAND

FIELD OF THE INVENTION

This invention relates to a razor for cutting hair, usually facial hair, and for trimming hair to provide a neat, groomed appearance.

BACKGROUND OF THE INVENTION

Many persons choose to shave body hair and will use different styles of shavers, razors and blades to achieve the desired effect. Razors are conveniently available in disposable models which can be discarded after the blades have been used and are no longer sharp enough to provide a close and comfortable shave. Some razors are also available with a more permanent blade holder in which the shaving head which contains the blades is disposed when no longer useful and replaced with a new shaving head or blade cartridge. Commonly, the blade cartridge or blade head contains blades which are a few centimeters in length and the razor is suitable to shave relatively large surfaces but is difficult to use for trimming small areas of hair such as sideburns and creating distinctive patterns such as "chin straps" in facial hair or is unsuitable for reaching between body parts other than the head and face.

An object of this invention is to provide a razor which is useful for shaving and trimming.

SUMMARY OF THE INVENTION

In accordance with this invention, there is provided a razor having an elongate handle body adapted at one end for attachment to a shaving head having blades of predetermined length, the handle body having a cavity for receiving a trimming wand, and a trimming wand adapted to be concealed in said cavity and to be selectively withdrawn from the cavity, the trimming wand having a trim blade at one end which is smaller in length than said predetermined length.

BRIEF DESCRIPTION OF THE DRAWINGS

In order to better understand the invention, several embodiments are described with reference to the accompanying drawings, in which.

DESCRIPTION OF PREFERRED EMBODIMENTS WITH REFERENCE To DRAWINGS

Figure 2:
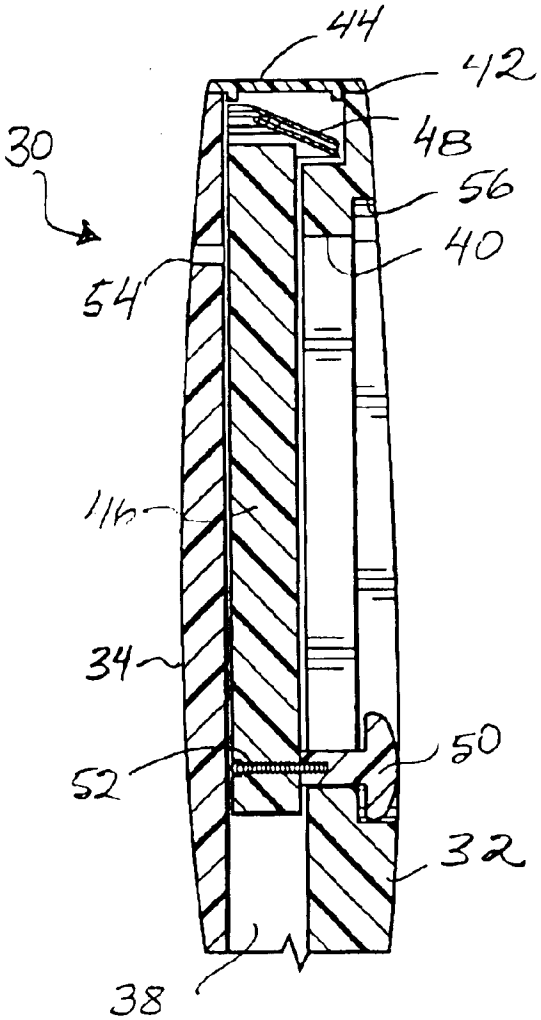
FIG. 2 is a cross-sectional view drawn on line 2—2 of FIG. 1.

A first embodiment of the invention is generally referred to by reference numeral 20 in FIGS. 1 to 4 of the accompanying drawings. The razor 20 is characterized by an elongate handle body 22 having a bottom end 24 which is adapted to be coupled to a disposable blade cartridge 26 in conventional fashion. The blade cartridge 26 is released from the handle body 22 by depressing the actuator 28 disposed on opposite sides of the handle body 22. It will be understood that the razor 20 may be provided without a blade cartridge 26 which would be obtained separately, as and when required.

Figure 4:
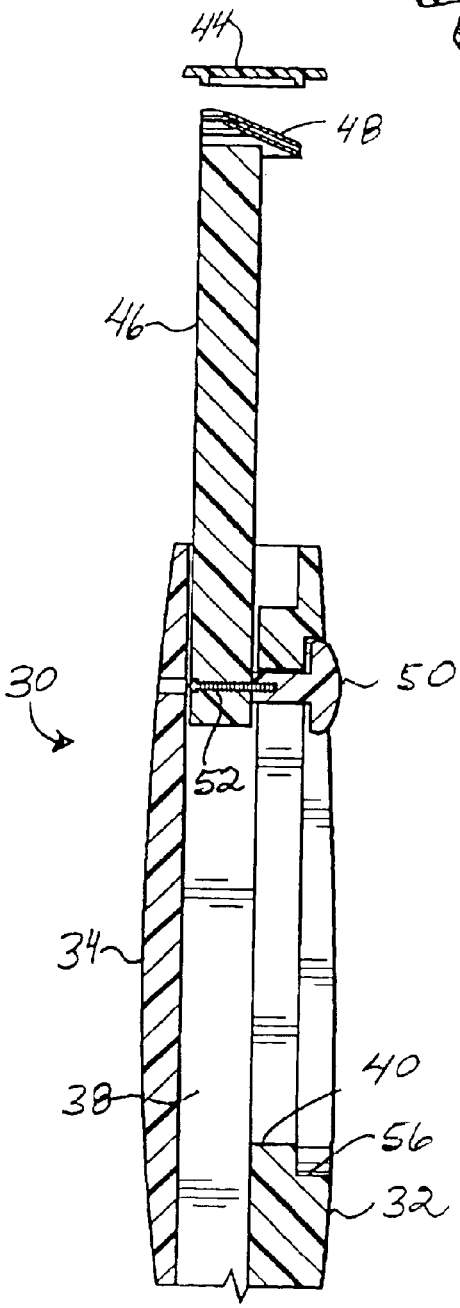
FIG. 4 is a cross-sectional view drawn on line 4—4 of FIG. 3.

The handle body 22 is narrow at the bottom end 24 and is wider at a top end 30 which is shown in more detail in the cross-sectional views of FIGS. 2 and 4. The handle body 22 is hollow and is defined by a front 32 a back 34 and a pair of oppositely disposed side 36 walls which together define a generally rectangular section and a central body cavity 38.

The front wall 32 has a slot guide 40 which communicates between the body cavity 38 and the exterior surface of the front wall 32 of the handle body 22. The slot guide 40 extends along a portion of the handle body 22 between the bottom end 24 and a top end 42 of the handle body which is open and is selectively closed by an end cap 44 as will be described in more detail below. A trimming wand 46 is concealed inside the central body cavity and consists of a longitudinally extending post having a pair of transversely disposed trim blades 48 at a top end thereof which are smaller in length than the blades of the blade cartridge 26 in order to perform more detail cutting of hair or other filaments. At a bottom end of the trimming wand 46, there is provided a transversely extending knob 50 secured to the wand with a threaded fastener 52. Access to the wand 46 in order to secure the fastener to the knob 50 is provided by an aperture 54 formed at the top end 30 of the handle body 22 in the back wall 34 opposite to the slot guide 40.

The knob 50 has a narrow stem which extends through the slot guide 40 and a wide head which prevents the knob from falling through the guide slot 40. Conveniently, the front wall 32 has a recess 56 formed adjacent slot guide 40 in order to accommodate the head of the knob 50 so that it does not protrude from the handle body 22.

Figure 1:
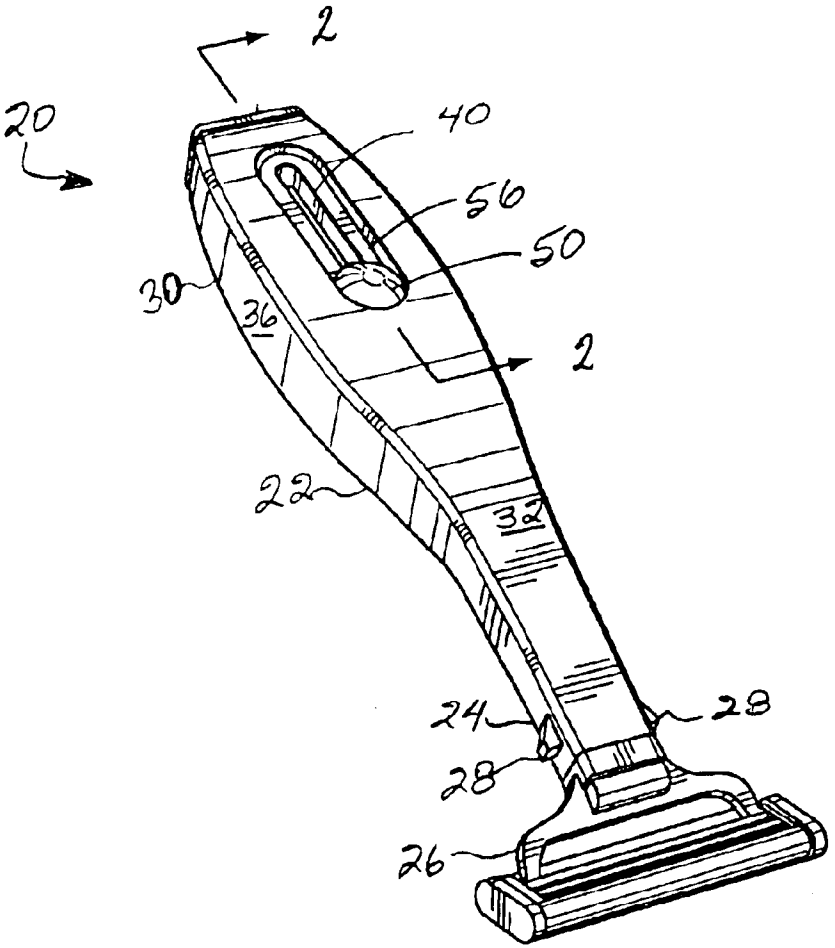
FIG. 1 is a perspective view from the front showing a first embodiment of the invention in which a razor has a trimming wand which is slidably received in one end of the razor body.
Figure 3:
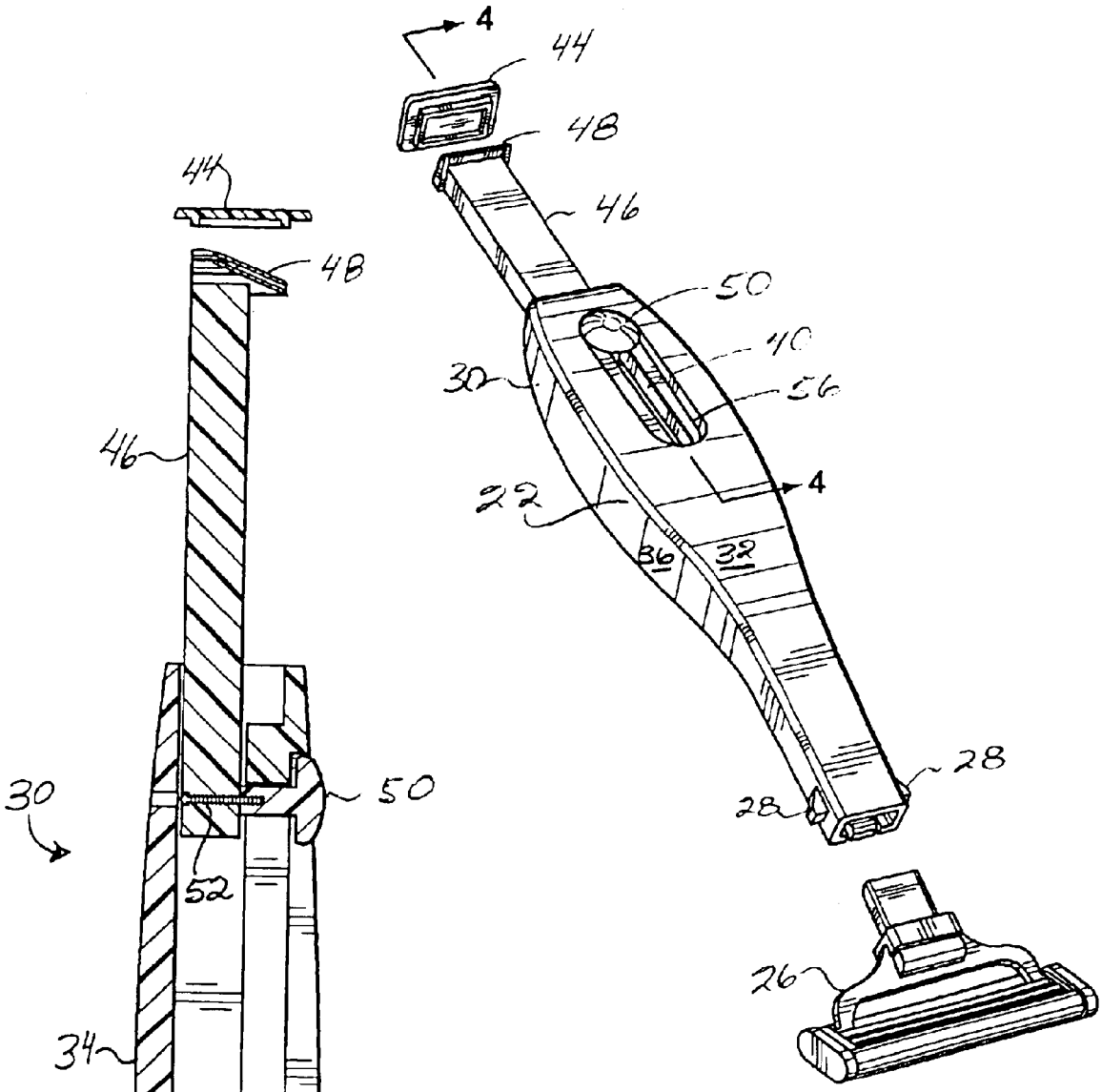
FIG. 3 is a similar view to FIG. 1 showing the trimming wand withdrawn from the razor body.

In use, the trimming wand 46 will normally be stored in the concealed position illustrated by FIGS. 1 and 2. When required, the end cap 44 is removed from the open, top end 42 of the handle body and the knob 50 is moved upwardly guided by the slot guide 40 so as to slide the trimming wand 46 upwardly into the retracted position illustrated in FIGS. 3 and 4 so that the trim blades 48 are exposed for use. The uppermost position of the trimming wand 46 is limited by the length of the slot guide 40. While it is expected that the friction between the knob 50 and the slot guide 40 will be sufficient to maintain the selected position of the trimming wand 46, the fastener 52 could optionally be provided with spring biasing means (not shown) to positively locate its position in the mounting aperture 54.

Figure 6:
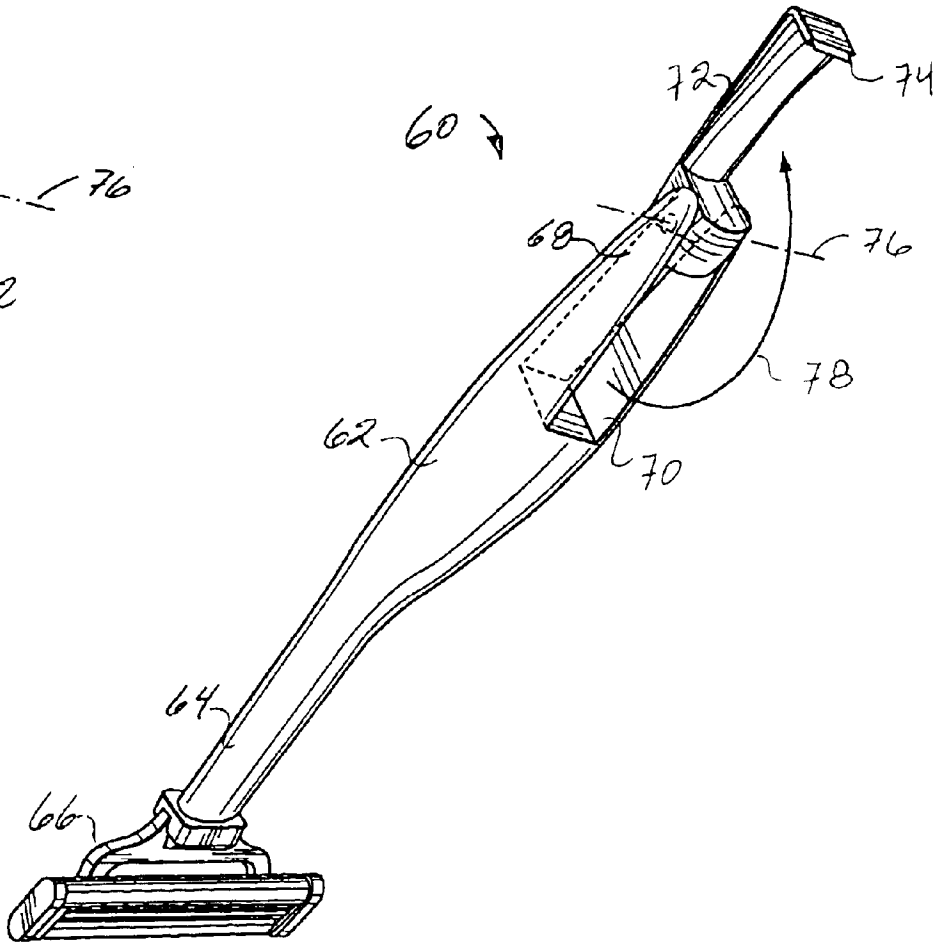
FIG. 6 is a similar view to FIG. 5 showing the trimming wand withdrawn from the razor body.
Figure 5:
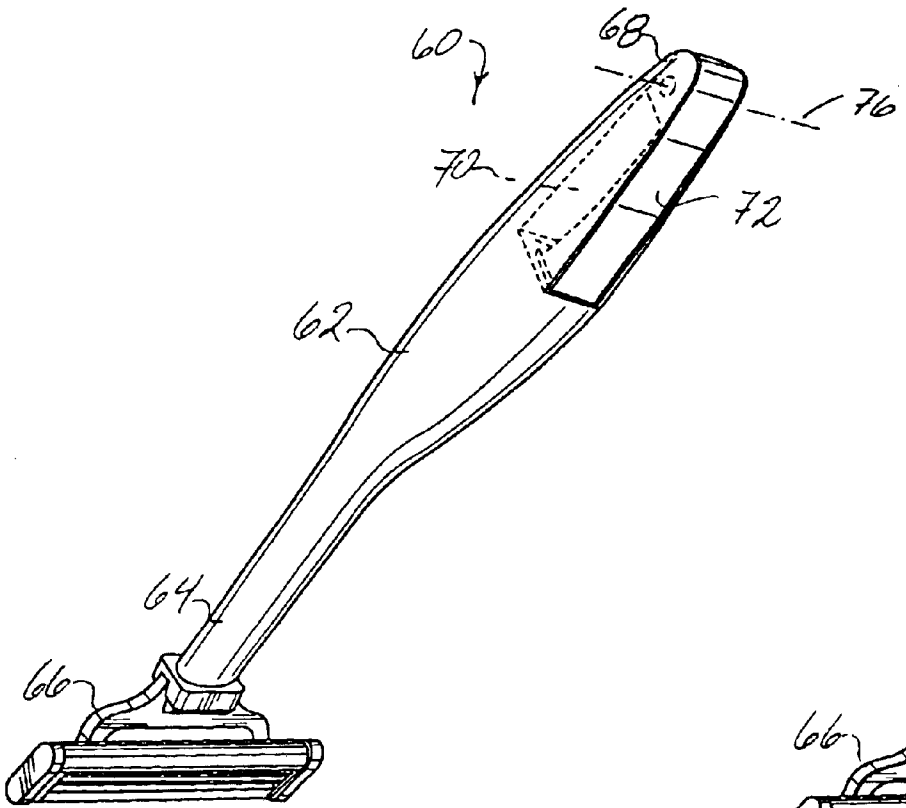
FIG. 5 is a perspective view from the back showing a second embodiment of the invention in which a razor has a trimming wand which is pivotally coupled to one end of the razor body.
Figure 8:
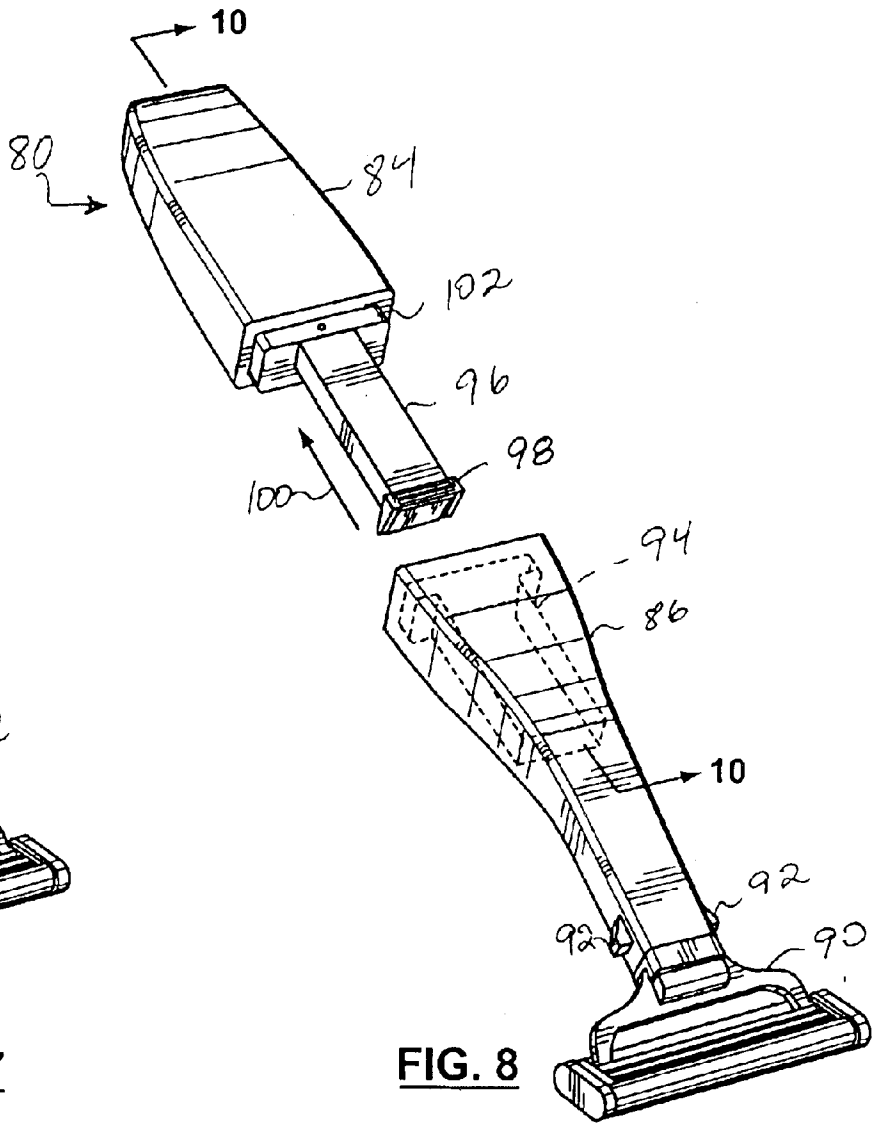
FIG. 8 is a similar view to FIG. 7 showing the trimming wand removed from the body.

In a second embodiment of the invention illustrated by FIGS. 5 and 6 of the accompanying drawings, the razor 60 likewise has a hollow handle body 62 in which the bottom end 64 is fixed to the shaving head 66. The handle body 62 has a more rounded cross-section with a narrow bottom end 64 and a wider top end 68 which is more oval. The body cavity defined by the handle body is indicated in FIG. 6 by reference numeral 70 where it is shown communicating with an outer back surface of the handle body.

In this embodiment of the invention, a trimming wand 72 with transversely disposed trim blades 74 provided at one end of the wand is pivoted from the other end of the wand to the top end 68 of the handle body for rotation along pivot axis 76 as indicated by arrow 78 between the stored position illustrated by FIG. 5 in which the trimming wand 72 is received in the body cavity 70 to be concealed by the handle body 62 and the flip position shown in FIG. 6 in which the trimming wand 72 is exposed for use.

Figure 7:
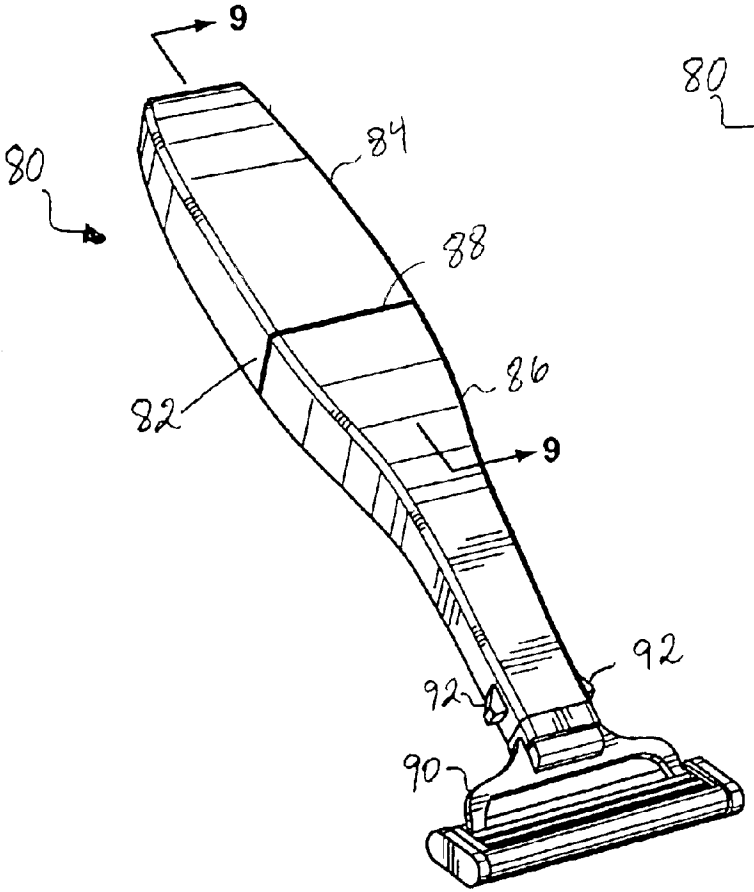
FIG. 7 is a perspective view from the front showing a third embodiment of the invention in which a razor has a separable body and a trimming wand which is slidably received in said body.
Figure 9:
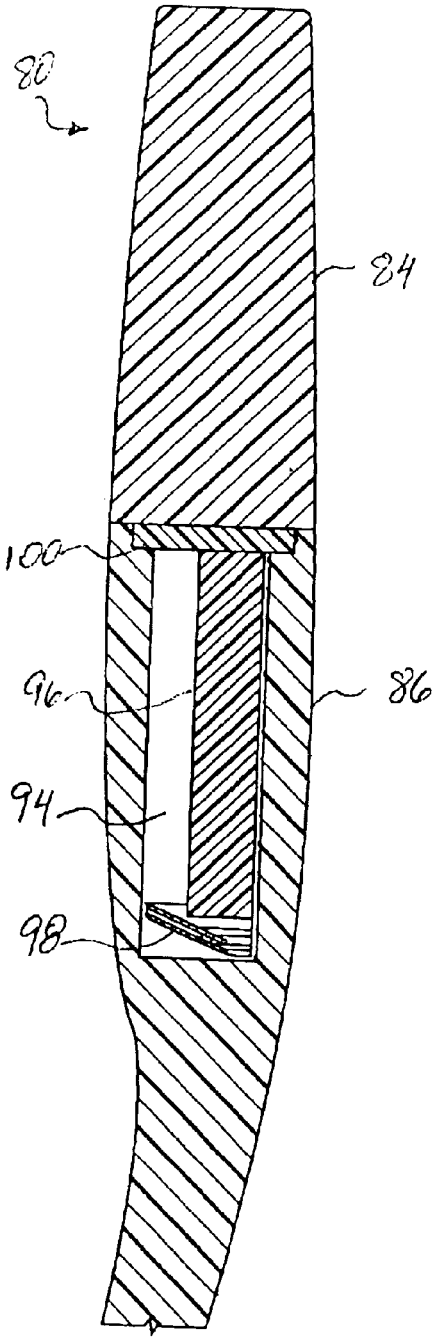
FIG. 9 is a cross-sectional view drawn on line 9—9 of FIG. 7.
Figure 10:
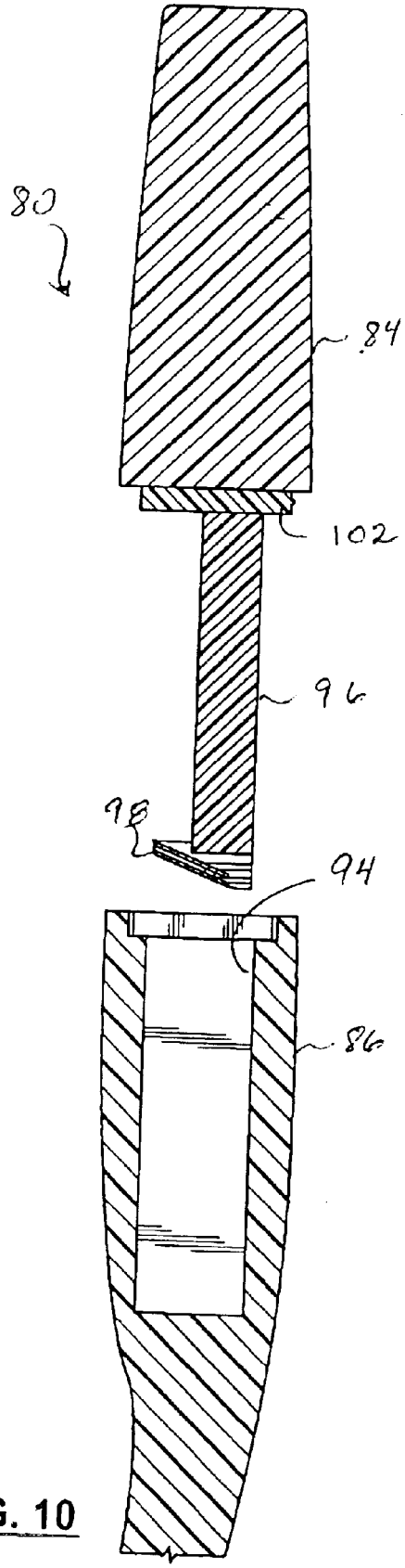
FIG. 10 is a cross-sectional view drawn on line 10—10 of FIG. 8.

In yet another embodiment of the invention illustrated by FIGS. 7 to 10 of the accompanying drawings, the razor generally indicated by reference numeral 80 has a handle body 82 formed in an upper body portion 84 and a lower body portion 86 which are complementary and separable from each other along a transverse line indicated by reference numeral 88 in FIG. 7. The lower body portion 86 has a separable, disposable blade cartridge 90 which is released by depressing actuators 92 as described with reference to FIG. 1, in conventional manner. It will be understood that the razor 80 could alternatively be provided with a fixed shaving head in the manner illustrated by the embodiment of FIGS. 5 and 6.

In the embodiment illustrated, the lower body portion 86 has a body cavity 94 formed therein for slidably receiving a trimming wand 96 which is fixed at a bottom end of the upper body portion 84 so as to extend outwardly therefrom along the length of the handle body 82. As in the other embodiments described, the trimming wand 96 has transversely disposed trim blades 98 at a free end of the wand which are exposed for use when the upper body portion 84 of the handle body 82 is withdrawn from the lower body portion 86 as indicated by directional arrow 100.

As seen in the drawings, the fixed end of the trimming wand 96 is coupled to the upper body portion at mounting block 102 which is inwardly spaced from the outer surface of the upper body portion to create a stepped configuration. The lower body portion 86 of the handle body 82 likewise has a complementary recess which forms part of the body cavity 94 to snugly receive the mounting block 102.

It will be understood that several variations may be made to the above-described embodiments of the invention within the scope of the appended claims, as will be apparent to those skilled in the art. For example, it will be understood that the shape of the handle body may be varied for aesthetic and ergonomic reasons and is not limited to the shapes illustrated in the accompanying drawings. Similarly, the nature and shape of the shaving head may be varied, in accordance with the intended usage of the razors. Several different means may be provided to combine a trimming wand with the handle body for a razor, the three embodiments described being illustrative of possible ways of doing so which should not be construed as limiting. For example, in the embodiment of FIGS. 7 to 10, it will be understood that the trimming wand 96 could alternatively be fixed to a lower body portion of the handle body with the receiving body cavity being defined by the upper body portion.

What is claimed is:

1. A razor having an elongate handle body adapted at a bottom end for attachment to a shaving head having blades of predetermined length, the handle body defining a body cavity for receiving a trimming wand, the trimming wand having at least one transversely disposed trim blade at one end which is smaller in length than said predetermined length, the trimming wand being adapted to be slidably received in the said handle body between a stored position in which the trimming wand is concealed in said cavity by the handle body and a retracted position in which the trimming wand is exposed a top end handle defining a receiving socket adapted to receive said transversely disposed trim blade and the handle body having a slot guide communicating between said body cavity and an exterior surface of the handle body and extending along a portion of the handle body between said bottom end and an open end of the handle body, the trimming wand having a knob extending transversely through said slot guide at a bottom end of the wand and slidable in said slot guide.

2. A razor having an elongate handle body adapted at a bottom end for attachment to a shaving head having blades of predetermined length, the handle body defining a body cavity for receiving a trimming wand, and a trimming wand adapted to be concealed in said cavity and to be selectively withdrawn from the cavity, the trimming wand having at least one transversely disposed trim blade at one end which is smaller in length than said predetermined length, the handle body being hollow and having an open end opposite said bottom end defining a receiving socket adapted to receive said transversely disposed trim blade, the trimming wand being adapted to be slidably received in the said handle body between a stored position in which the trimming wand is concealed by the handle body and a retracted position in which the trimming wand is exposed, and an end cap to close the open end.

3. A razor having an elongate handle body adapted at a bottom end for attachment to a shaving head having blades of predetermined length, the handle body defining a body cavity for receiving a trimming wand, and a trimming wand adapted to be concealed in said cavity and to be selectively withdrawn from the cavity, the trimming wand having at least one transversely disposed trim blade at one end which is smaller in length than said predetermined length, the handle body being formed in two complementary body portions separable from each other, one said body portion having said body cavity and defining a receiving socket adapted to receive said trim blade, and the other said body portion having said trimming wand extending outwardly therefrom along the length thereof and adapted to be slidably received in said body cavity so that the trimming wand may be concealed in said cavity by the handle body and selectively removed therefrom.

* * * * *